United States Patent [19]

Jenkinson

[11] 4,178,129

[45] Dec. 11, 1979

[54] GAS TURBINE ENGINE COOLING SYSTEM

[75] Inventor: John Jenkinson, Bristol, England

[73] Assignee: Rolls-Royce Limited, London, England

[21] Appl. No.: 874,741

[22] Filed: Feb. 3, 1978

[30] Foreign Application Priority Data

Feb. 18, 1977 [GB] United Kingdom ..... 6860/77

[51] Int. Cl.[2] ..... F01D 5/18

[52] U.S. Cl. ..... 416/95; 416/193 A

[58] Field of Search ..... 416/95, 92, 96, 193 A; 415/115, 116

[56] References Cited

U.S. PATENT DOCUMENTS

| | | | |
|---|---|---|---|
| 2,945,671 | 7/1960 | Petrie | 415/115 |
| 2,988,325 | 6/1961 | Dawson | 415/115 |
| 3,015,937 | 1/1962 | Giliberty | 415/116 |
| 3,635,586 | 1/1972 | Kent et al. | 416/96 |
| 3,719,431 | 3/1973 | Steele et al. | 416/95 |
| 3,768,921 | 10/1973 | Brown et al. | 415/116 |
| 3,791,758 | 2/1974 | Jenkinson | 416/92 |
| 3,834,831 | 9/1974 | Mitchell | 416/193 |
| 3,936,215 | 2/1976 | Hoff | 415/115 |
| 4,008,977 | 2/1977 | Brown et al. | 416/95 |

*Primary Examiner*—Everette A. Powell, Jr.
*Assistant Examiner*—A. N. Trausch, III
*Attorney, Agent, or Firm*—Stevens, Davis, Miller & Mosher

[57] ABSTRACT

In a blade cooling system for a turbine of a gas turbine engine each blade root is provided with individual pitot receivers which collect a portion of a cooling fluid flow supplied from an annular array of pre-swirl nozzles, which have a circumferentially continuous outlet flow area, and direct said flow into a portion only of the interior of the blade, preferably adjacent the leading edge.

7 Claims, 8 Drawing Figures

Fig.1.
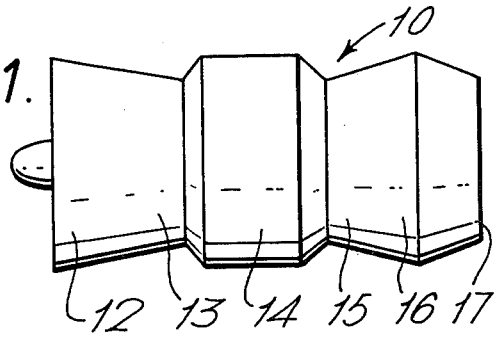
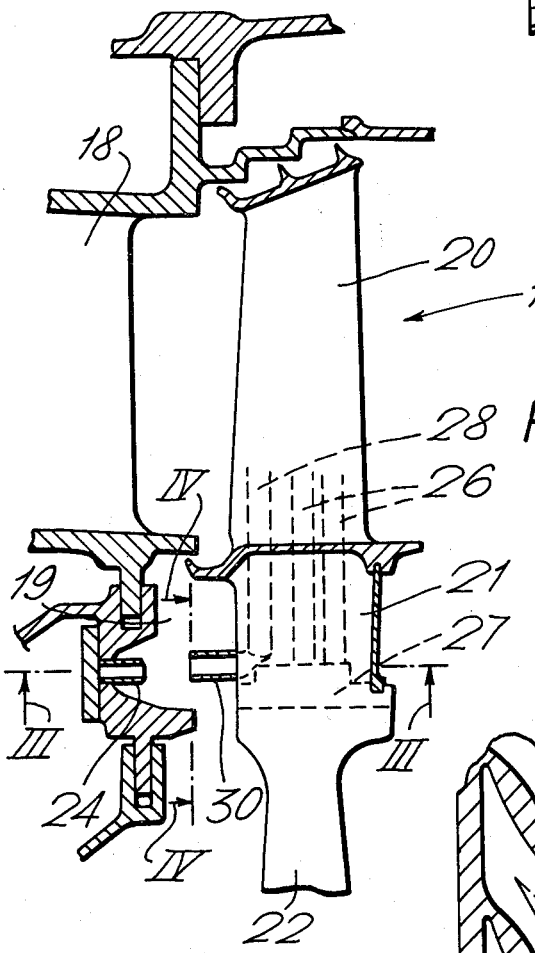
Fig.2.
Fig.3.
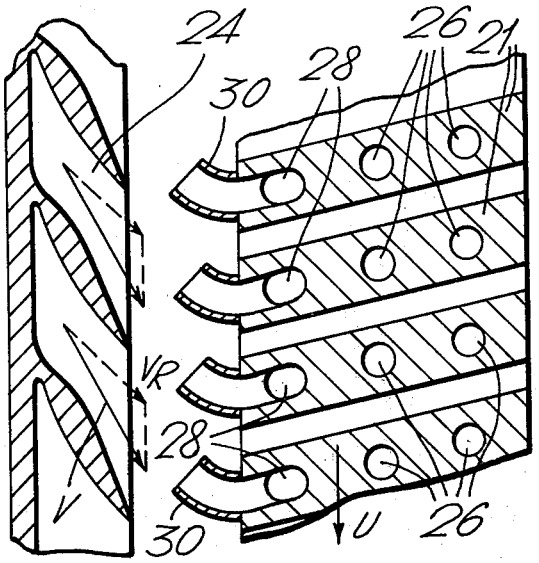

GAS TURBINE ENGINE COOLING SYSTEM

This invention relates to gas turbine engine cooling systems and relates more particularly to a system for providing cooling air to the interiors of the blades of a turbine of a gas turbine engine.

It has become increasingly necessary in recent years to use cooled turbine blades in gas turbine engines. The main reason for this is that it permits such turbines to be operated at higher temperatures than would be permissible with uncooled turbine blades. The high operating temperature permitted by the use of such blades thus results in increased engine efficiency and performance.

In the past there have been several methods used for providing the flow of cooling air to the turbine blades. One known system of turbine blade cooling has made use of pre-swirl nozzles located upstream of the turbine disc. These nozzles produce a drop in the static temperature and pressure of the cooling air. For collecting the cooling air, the turbine disc is provided with apertures, and passages in the disc direct the air from the apertures into the turbine blades. The main disadvantage with this type of system is that the loss in cooling air pressure which accompanies the temperature drop through the pre-swirl nozzles cannot be efficiently regained in the collecting apertures. This obviously reduces the cooling effectiveness of the cooling air particularly in the leading edge cooling passages of the turbine blades where it is becoming increasingly the practice to exhaust the cooling air at or near to the stagnation pressure on the leading edge of the blade, and therefore it is essential that the cooling air pressure is as high as possible.

In order to increase the pressure of the cooling air at the blades it is possible to tap the cooling air from a higher pressure region of the engine, for example the compressor outlet, but the more stages of compression the air undergoes in the compressor the greater its temperature becomes, so that the cooling efficiency gained by using higher pressure air is offset by the loss in cooling effectiveness of the higher temperature air.

The choice of cooling air pressure has therefore been a compromise between these two conflicting requirements.

Alternative methods of providing higher pressure cooling air to the turbines blades have been used. In one method the turbine disc is split and cooling air is pumped up the centre of the disc to the blades by centrifugal force to increase its pressure. In another method a cover plate is spaced closely adjacent the turbine disc to define a space through which cooling air is pumped by centrifugal effects to the disc rim from where it is transferred to the turbine blades through holes provided in the disc. Both of these methods of cooling require relatively costly structures which result in increasing the weight and cost of the engine, and both have the disadvantage that the air becomes heated due to windage on the rotating parts of the engine, thus resulting in a loss in cooling efficiency.

The object of the present invention is to provide a gas turbine engine cooling system which substantially overcomes the abovementioned disadvantages.

According to the present invention, a cooling system for the turbine of a gas turbine engine comprises a circumferentially extending array of pre-swirl nozzles arranged to provide a substantially continuous annular outlet flow area through which passes, in operation, a flow of cooling fluid, and a circumferential array of individual pitot receivers disposed on the turbine downstream of the pre-swirl nozzles, the pitot receivers being sized and positioned to collect a portion only of the pre-swirled cooling fluid from the nozzles and to direct it to a portion only of the interior of each of the blades of the turbine.

The pitot receivers may be secured to, or form a part of, each turbine blade root, or alternatively, each pitot receiver may be secured to the turbine disc which is provided with communicating passageways to the interior of at least a portion of each blade.

Preferably the cooling air from the pitot receivers is supplied to the hollow interior of the leading edge portion only of each turbine blade.

The pitot receivers are preferably angled such that their inlets are disposed normal to the relative approach angle of the air from the pre-swirl nozzles whereby there is no substantial loss in total pressure of the cooling air between the pre-swirl nozzles and the pitot receivers.

Further apertures may be provided within the turbine disc or blade roots to collect a further portion of the cooling air from the pre-swirl nozzles and to direct it to the remaining portions of the hollow interior of the turbine blades, where it may pass through a diffuser before entering a further longitudinal cooling passage or passages in the blade. A further portion of cooling air may be used for air sealing purposes.

An embodiment of the invention will now be more particularly described by way of example only, and with reference to the accompanying drawings, in which:

FIG. 1 shows a pictorial view of a gas turbine engine of an embodiment of the present invention.

FIG. 2 shows in greater detail and on an enlarged scale the view shown diagrammatically at FIG. 1.

FIG. 3 shows a view taken on line III—III of FIG. 2,

Figure 4:
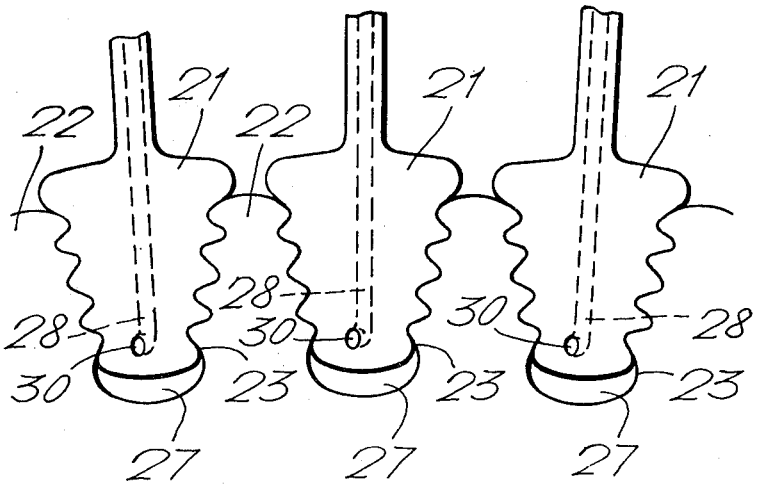
FIG. 4 is a view on the line IV—IV of FIG. 2.

Referring to the drawings, a gas turbine engine shown generally at 10 comprises in flow series a low pressure compressor 12, a high pressure compressor 13, combustion equipment 14, a high pressure turbine 15, a low pressure turbine 16, the engine terminating in an exhaust nozzle 17.

FIGS. 2 to 4 show a cross-sectional view of the high pressure turbine 15 and a nozzle guide vane assembly 18 upstream thereof. Each blade 20 of the turbine has a root portion 21, part of which is shaped into a conventional "fir tree" configuration for attachment to correspondingly shaped slots 23 (FIG. 4) in the rim of the high pressure turbine disc 22. The high pressure turbine 15 is spaced downstream from the nozzle guide vane assembly by a space 19, and the nozzle guide vane assembly includes a circumferential array of pre-swirl nozzles, one of which is shown at 24. High pressure cooling air is bled either from the engine compressor, or alternatively, from the dilution or secondary air section of the combustion section 14 of the engine, and this air is passed through the pre-swirl nozzles and is directed with a circumferential component of velocity towards the roots 21 of the turbine blades 20. The thicknesses of the walls between the nozzles at the outlet plane are minimized to provide a substantially continuous outlet flow area (see FIG. 3).

Each of the blades 20 is provided with one or more cooling air passages 26 which extend longitudinally through the aerofoil-shaped portion thereof and which communicate at their root ends with a cooling air supply chamber 27 formed at the bottom of the blade root-receiving slot 23.

A further cooling air passage 28 extends longitudinally through each blade within the leading edge part thereof, and this passage communicates with a pitot receiver 30 which is formed integrally with the blade root 21.

With present blade-cooling techniques there is a requirement for cooling air at the highest available pressure to be supplied to the leading edge cooling air passage 28. Use of pitot receivers 30 to collect the cooling air for the leading edge cooling passage 28 from the nozzles 24, enables a high pressure cooling air flow to be provided at the leading edge at lower temperature than has been possible previously.

The aerodynamic theory of operation of a pitot tube is well-known and need not be stated here. The nozzles 24 are arranged to direct significantly more cooling air at the pitot receivers than is required in the leading edge cooling air passage 28, and the inlet area of the pitot receiver is arranged to be greater than the inlet area of the passage 28 so that the inlet to the passage 28 represents a restriction to the flow through the pitot receiver. With this arrangement there will be spillage of the excess air flow around the entry of the pitot receiver, and the pitot receiver will recover a significant amount of the total pressure of the air flowing through the nozzles. The amount of pressure recovery is optimized in any given engine configuration by balancing various interdependent parameters such as the quantity of cooling air required for the remaining cooling air passages 26 in the blade, the amount of spillage required by the pitot receivers to achieve optimum pressure recovery, and the quantity, temperature and pressure of the air flow in the nozzles 24.

In the embodiment illustrated in FIGS. 2, 3 and 4 all of the flow through the nozzles 24 is directed at the pitot receivers and part of the spillage around them is used for disc cooling and aerodynamic sealing, while the remainder enters the chamber 27 and passes into the cooling air passages 26 in the blade.

The pitot receivers on the blades extend forwardly across the space 19 into close proximity with the nozzles 24 to define the minimum clearance allowing for relative movements of the rotating and static structures to which they are respectively attached.

The pitot receivers 30 therefore, which lie in the high velocity air stream from the nozzles 24, will collect a portion of the air and increase its pressure to a pressure close to its relative total pressure with virtually no increase in temperature. The air entering the chambers 27 however, do not recover the full total pressure of the cooling air because the free stream conditions do not apply on the disc face, and the relative dynamic pressure of the flow is destroyed on the disc sidewalls as the flow is distorted on its way into the apertures. In fact the pressure in the chambers 27 may be less than the static pressure because of the entry losses as the air enters the chamber.

By taking advantage of the efficient recovery potential of the pitot receivers for that part of the cooling air required for the leading edge cooling flow, compared to tapping the flow from chambers 27 as in a conventional system, it is now possible to tap cooling air from a higher pressure stage of the engine compressor or from the combustion section of the engine, and to cool it to its maximum extent during passage through the nozzles 24. This is achieved by suitable design of the nozzles to achieve maximum velocity at their exit plane. Thus, in the present example, the highest pressure air is used from the compressor and the pressure ratio across the nozzles is then such that the nozzles are of convergent-divergent design and produce supersonic velocities in the air flow at their exit plane.

This velocity increase provides a greater temperature drop in the flow and since the pitot receivers are moving with the blades, this temperature drop relative to the blades is maintained because the flow is not brought to rest.

Although the static pressure at the outlet of the nozzles may be the same as in the conventional system, the much higher velocity of the cooling air flow from the nozzles means that its total pressure relative to the pitot receivers is greater than in the conventional system, and the pitot receivers can efficiently reclaim this pressure, with a minimum rise in temperature. The result is that the inlet to the blade passage is now supplied with cooling air at a low relative temperature and higher relative pressure than in the conventional system.

To minimize losses in the pitot receivers they are angled to lie in line with the relative velocity vector of the cooling air flow from the pre-swirl nozzles, i.e. with their inlets normal to this vector.

A comparison of the improvement which can be obtained by providing pitot receivers on the turbine in place of the conventional apertures in the disc is as follows:

| | Conventional System | Pitot System |
|---|---|---|
| Nozzle supply pressure | 48 psia (5th stage comp. bleed) | 90 psia comp. delivery bleed |
| Nozzle supply temperature | 790° K. | 830° K. |
| Nozzle outlet static temperature | 734° K. | 639° K. |
| Nozzle outlet static pressure | 36 psia | 36 psia |
| Nozzle design | Convergent | Convergent-divergent |
| Cooling air relative total temp. | 744° K. at disc face | 703° K. at pitot receivers |
| Cooling air relative total Press | 37.8 psia at disc face | 50.4 psia at pitot receivers |

Although recovery of the full total pressure of 50.4 psia in the pitot receivers will be accompanied by some temperature rise it is to be noted that the cooling air temperature is already approximately 40° K. lower than in the conventional system.

The above example demonstrates the significant benefits obtainable using the pitot recovery principle starting with the highest pressures in the engine and using convergent-divergent pre-swirl nozzles. Clearly the benefits of using the pitot receivers can be gained using lower pressures of cooling air from the compressor but the advantages will be less. The convergent-divergent pre-swirl nozzles are therefore only required when the pressure drop across the nozzles is sufficient to enable supersonic velocities to be achieved.

The pitot recovery principle can only be applied to a part of the cooling air from the nozzles because of the need for spillage of air around the pitot receivers 30 in order to regain the greatest possible static pressure in the receivers. However, a gain in cooling efficiency in the secondary passages 26 may also be produced by taking advantage of the lower relative total temperature of the cooling air in the space 19. Thus by shaping the chambers 27 for diffusion of the flow through the apertures some pressure recovery can be achieved, although this recovery process will be at a much lower efficiency than in the pitot receivers.

Figure 5:
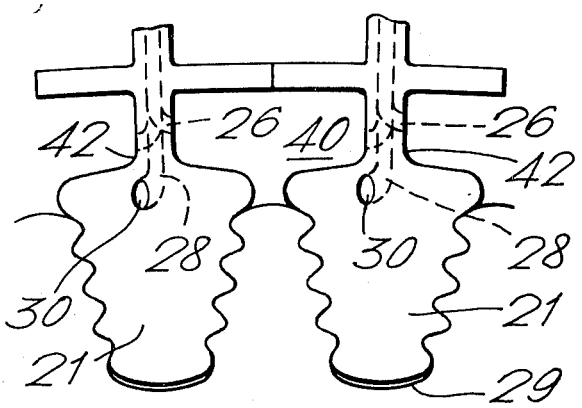
FIG. 5 is a view similar to that of FIG. 4 but illustrating a modified embodiment of the invention.

In a modification to the above-described system shown in FIG. 5, the pre-swirl nozzles 24 are moved outwardly as far as the disc rim. Instead of the relatively small apertures 23 below the blade roots, the spaces 40 between the blade shanks 42 can now be used as collectors to provide much greater collecting area and thus much more flexibility to improve pressure recovery in the air used for the secondary passages 26. The cooling air is fed into the blade passages through passages in the blade shanks. The pitot receivers 30 are formed on the blade shanks so that they do not interfere with the available area in the spaces between the blade shanks. In this example the spaces 40 may be trumpet-shaped as described in the specification to our U.K. Pat. No. 1,350,471.

Clearly more than one passage in the blade root can be fed from a pitot receiver system but since the pitot receivers can only be effective with a proportion of the flow through the nozzles 24, only a limited number of passages can be supplied with the high pressure from these devices.

The combined use of pitot receivers for supplying cooling air to the blade passages which require the greatest pressure, and diffusing passages to give some pressure recovery in the remaining passages provides an efficient overall blade cooling system which is simple to produce and which adds very little weight to the turbine and is described with reference to FIGS. 6, 7 and 8.

Figure 6:
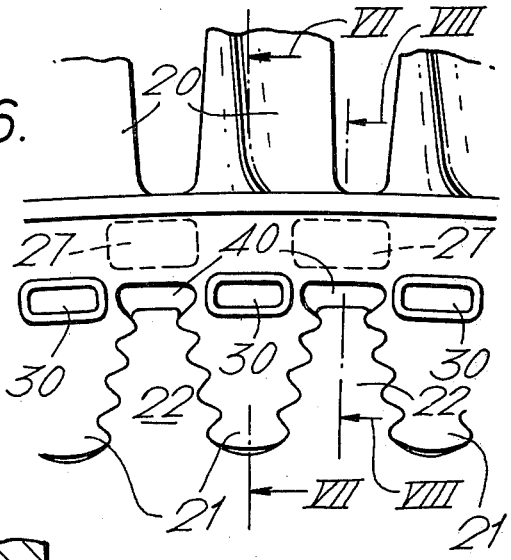
FIG. 6 is an elevation of part of a disc and blade assembly including a further alternative embodiment of the invention.
Figure 7:
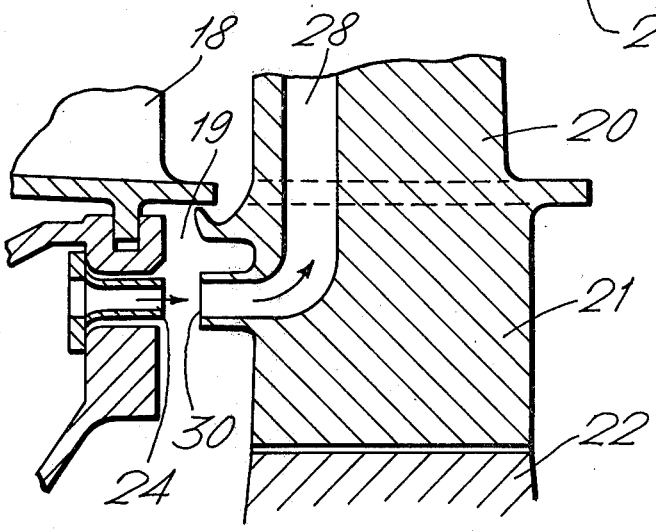
FIG. 7 is a section on the line VII—VII of FIG. 6.
Figure 8:
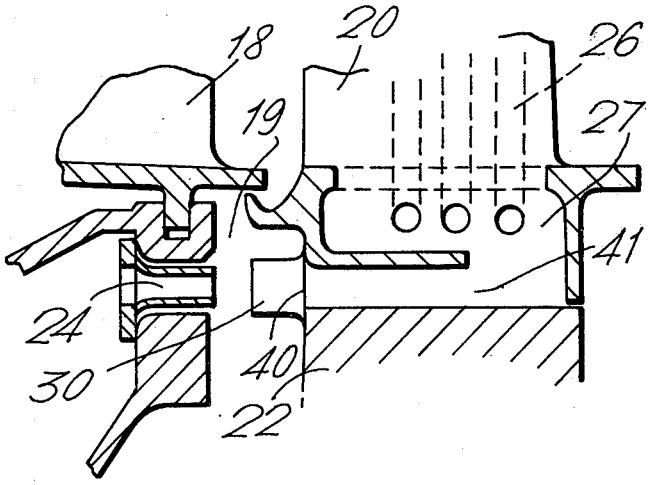
FIG. 8 is a section on the VIII—VIII of FIG. 6.

Referring now to FIGS. 6, 7 and 8, the same reference numerals are given to those constructional features which are the same as in FIGS. 2 to 5.

In FIG. 6 it can be seen that the pitot receivers 30 for each blade 20 are circumferentially elongate in shape to reduce end effects, and the entry apertures 40 to the chambers 27 in each blade root are alongside them. Air entering each diffuser aperture 40 passes through a sudden enlargement of flow area at the exit from the entry passage 41 to raise the static pressure of the air as it passes into the chamber 27.

This combination of pitot receivers and diffusers makes efficient use of the available cooling air from the nozzles 24.

I claim:

1. A cooling system for a turbine of a gas turbine engine, said system comprising a turbine rotor with blades extending therefrom:

a plurality of circumferentially closely spaced pre-swirl nozzles defining a substantially continuous annular outlet flow area through which flows, in operation, a cooling fluid; and a plurality of circumferentially spaced pitot receivers projecting from the blades of the turbine in a direction towards the pre-swirl nozzles and terminating at their free open inlet ends in closely spaced relation to the nozzles with the ends being substantially perpendicular to the relative approach vector of the fluid from the nozzles, the pitot receivers being sized and positioned to collect a portion only of the pre-swirled cooling fluid from the nozzles and to direct it to a portion only of the interior of each of the blades of the turbine.

2. A cooling system as claimed in claim 1 and in which each turbine blade of the turbine is provided with a pitot receiver on a root portion thereof.

3. A cooling system as claimed in claim 1 and in which each pitot receiver supplies cooling fluid to a leading edge cooling fluid passage in the respective blade.

4. A cooling system for a turbine of a gas turbine engine comprising a turbine rotor with blades extending therefrom, a circumferentially extending array of pre-swirl nozzles arranged to provide a substantially continuous annular outlet flow area through which passes, in operation, a flow of cooling fluid, and a circumferential array of individual pitot receivers projecting from the blades of the turbine towards the pre-swirl nozzles and disposed on the turbine downstream of the pre-swirl nozzles, the pitot receivers being sized and positioned to collect a portion only of the pre-swirled cooling fluid from the nozzles and to direct it to a portion only of the interior of each of the blades of the turbine, each pitot receiver being disposed with its inlet normal to the relative approach vector of the fluid from the pre-swirl nozzles.

5. A cooling system for a turbine of a gas turbine engine comprising a turbine rotor with blades extending therefrom, a circumferentially extending array of pre-swirl nozzles arranged to provide a substantially continuous annular outlet flow area through which passes, in operation, a flow of cooling fluid, and a circumferential array of individual pitot receivers projecting from the blades of the turbine towards the pre-swirl nozzles and disposed on the turbine downstream of the pre-swirl nozzles, the pitot receivers being sized and positioned to collect a portion only of the pre-swirled cooling fluid from the nozzles and to direct it to a portion only of the interior of each of the blades of the turbine, and each blade has more than one cooling fluid passage in the interior thereof and the pitot receivers are arranged with their inlets normal to the relative approach vector of the fluid from the pre-swirl nozzles to supply cooling fluid to at least one, but not all, of the passages, further cooling fluid receivers being disposed on the turbine to collect a further portion of the cooling fluid from the nozzles and to direct it to any remaining passage in the blade.

6. A cooling system as claimed in claim 5 and in which each turbine blade of the turbine is provided with a pitot receiver on a root portion thereof.

7. A cooling system as claimed in claim 5 and in which the further cooling fluid receivers direct the cooling fluid received therein to diffusing chambers in the root portion of each blade with which the remaining cooling fluid passage or passages in the blade communicate.

* * * * *